US006039642A

United States Patent [19]

Collins

[11] Patent Number: 6,039,642

[45] Date of Patent: Mar. 21, 2000

[54] BLADE SHARPENER

[76] Inventor: Walter W. Collins, P.O. Box 100, North, S.C. 29112

[21] Appl. No.: 09/153,163

[22] Filed: Sep. 15, 1998

[51] Int. Cl.[7] ..... B24B 3/54

[52] U.S. Cl. ..... 451/557; 76/86; 451/45; 451/549

[58] Field of Search ..... 451/557, 45, 549; 76/86–89

[56] References Cited

U.S. PATENT DOCUMENTS

| | | | |
|---|---|---|---|
| D. 365,740 | 1/1996 | Smith | D8/93 |
| D. 372,180 | 7/1996 | Powell | D8/91 |
| 1,595,322 | 8/1926 | Tanner | 76/87 |
| 2,446,909 | 8/1948 | Davis | 76/87 |
| 2,520,279 | 8/1950 | Gallo | 76/87 |
| 3,719,461 | 3/1973 | Topping | 51/204 |
| 4,558,540 | 12/1985 | Collins | 76/88 X |
| 4,672,777 | 6/1987 | Dunkin | 76/87 X |
| 5,283,920 | 2/1994 | Plummer | 7/106 |

*Primary Examiner*—David A. Scherbel
*Assistant Examiner*—Anthony Ojini
*Attorney, Agent, or Firm*—Leatherwood Walker Todd & Mann, P.C.

[57] ABSTRACT

A blade sharpener having a magazine slidably carried within a sleeve. The magazine contains two sets of three sharpening wheels carried for rotation within the magazine, which are positioned in a staggered relationship with respect to one another, such that each set of three sharpening wheels forms two sharpening interfaces. Two channels are defined in the magazine and are generally in alignment with each of the two sharpening interfaces. The magazine is movable with respect to the sleeve, and may be selectively fixed in at least three positions relative thereto with a spring-biased push-button. For storage or transport, the magazine is moved into the sleeve such that both sets of the sharpening wheels are housed within the sleeve. The magazine of the blade sharpener is also provided with an elongated sharpening rod which is pivotally connected to the magazine, and which is used to sharpen serrated blades.

18 Claims, 4 Drawing Sheets

BLADE SHARPENER

BACKGROUND OF THE INVENTION

This invention relates generally to a sharpening tool for sharpening knives and other blades.

To optimize cutting performance, blades must be maintained in a sharpened state. Sharpening of a blade during the manufacturing thereof is typically performed using powered abrasive belts or wheels and with specific fixtures which present the blade at the correct angle for sharpening. Accordingly, when the user purchases the blade, whether it is in a knife, pair of scissors, or lawnmower blade, etc., the blade is sharp and ready for use.

However, as the blade is put into use and encounters abrasive surfaces in the materials being cut, the blade eventually loses its sharpness, thereby reducing the blade's cutting effectiveness. This requires the user to again sharpen the blade to restore the original sharp edge.

Since sharpening can be a time consuming, tedious process, the user may avoid it. Sharpening of the blade may also be neglected by the user because of a hesitancy in their ability to actually bring a sharp edge to the blade. Accordingly, once the blade has been put into use and is dulled, it often times is not re-sharpened, thereby reducing the value of the blade as an effective tool.

Various devices have been patented for sharpening blades. U.S. Pat. No. 1,595,322, issued to Tanner, discloses a sharpening device having two rotatable sharpening discs connected to a handle. U.S. Pat. No. 2,446,909, issued to Davis, discloses a knife sharpener having three beveled sharpening discs. The discs, in combination, provide two sharpening interfaces to allow for both a rough and finishing sharpening of a blade. U.S. Pat. No. 2,520,279, issued to Gallo, discloses a device having three discs in series, the central disc being hardened about its periphery. U.S. Pat. No. 4,558,540, issued to the present applicant, discloses a knife sharpener having a tray which holds a sharpening element. A push button is provided for locking the tray with respect to a handle.

While the foregoing designs are known, there still exists a need for a compact and easy to use sharpener which requires little or no skill to operate and which presents a blade to sharpening media at a proper angle for sharpening.

SUMMARY OF THE INVENTION

It is, therefore, the principal object of this invention to provide a versatile blade sharpener having a compact and easily usable design.

Another object of the present invention is to provide a blade sharpener which presents a blade to sharpening media at a proper angle for sharpening.

Yet another object of the present invention is to provide a blade sharpener which can be used to sharpen both straight edged and serrated edged blades.

Still another object of the present invention is to provide a blade sharpener that provides for both a coarse and finish sharpening.

Generally, the present invention includes a blade sharpener having a magazine slidably carried within a sleeve. The magazine contains six sharpening wheels. Three of the sharpening wheels are used for providing a coarse sharpening to a blade, and the remaining three sharpening wheels are used to provide a finishing, or fine, sharpening to the blade, typically after the blade has received a coarse sharpening.

Each set of the three sharpening wheels are carried for rotation within the magazine, and are positioned in a staggered relationship with respect to one another, such that each set of three sharpening wheels forms two sharpening interfaces. Two channels are defined in the magazine for each sharpening wheel set, and these two channels correspond to and are generally in alignment with the two sharpening interfaces.

The magazine is movable with respect to the sleeve, and may be selectively fixed in at least three positions relative thereto. A spring-biased detent device, such as a pushbutton, is provided in the magazine and selectively registers with openings provided in the sleeve in order to fix the magazine at a desired position with respect to the sleeve. For example, in one such position, the set of sharpening wheels for providing a coarse sharpening to the blade extend outwardly from the sleeve, available for use in sharpening. The user would typically hold the sleeve in one hand, and would draw the blade through the two sharpening channels associated with the set of coarse sharpening wheels.

After coarse sharpening, the pushbutton in the magazine would be depressed to take it out of registry with the opening in the sleeve, and the magazine and sleeve would be moved with respect to one another such that the set of finish sharpening wheels are exposed. The magazine would then be locked in position with respect to the sleeve through registry of the pushbutton with another of the openings in the sleeve. Again, the user would typically hold this sleeve in one hand while drawing the blade through the two sharpening channels associated with the two fine sharpening interfaces associated with this set of sharpening wheels.

For storage or transport, the magazine is moved into the sleeve such that both sets of the sharpening wheels are housed within the sleeve, and the magazine is maintained in this position with respect to the sleeve through registry of the pushbutton with the remaining opening of the sleeve.

The features of the present invention have been discussed generally at this point as directed to sharpening a straight edged blade. However, the present invention is also drawn to a blade sharpener for use with blades having irregular or serrated edges. To this end, the magazine of the blade sharpener is also provided with an elongated sharpening rod which is pivotally connected to the magazine and which normally resides in a channel provided along an edge of the magazine. The sharpening rod is of an elongated conical shape and is used to sharpen non-straight edged blades, such as serrated blades, by drawing the sharpening rod along the serrations of the blade. To do this, the magazine is removed entirely from the sleeve, and the sharpening rod is pivoted from its normal position within the channel, to an extended, sharpening position. The magazine is then reinserted into the sleeve until the pushbutton registers with an opening therein. The sharpening rod is held securely fixed with respect to the magazine through interaction of the sleeve, sharpening rod, and magazine. This provides a sturdy handle by which the user holds the sharpening rod in the extended position in order to sharpen a blade.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
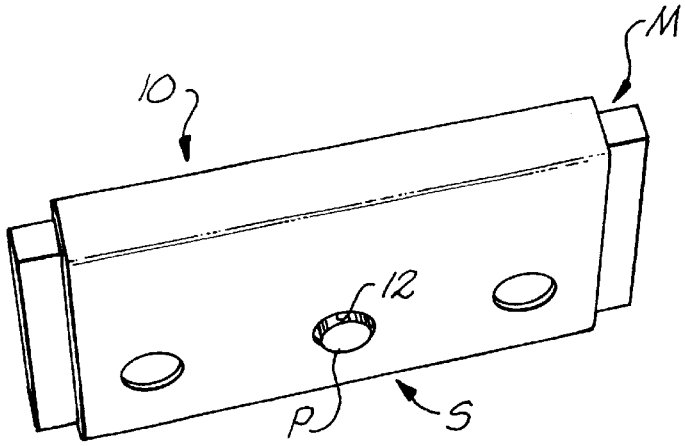
FIG. 1 is a perspective view of a blade sharpener constructed in accordance with the present invention, illustrating the magazine stored within the sleeve.

The accompanying drawings and the description that follows set forth this invention in its preferred embodiment. However, it is contemplated that persons generally familiar with blades and sharpeners will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the blade sharpener of the present invention is indicated generally in the figures by reference character 10.

Turning first to FIG. 1, blade sharpener 10 is shown having a body member, or magazine, generally M, carried within a sleeve, generally S, in what would typically be storage or transport configurations. Pushbutton, generally P, is shown registering with opening 12 defined in sleeve S, this opening 12 being used to maintain the magazine in a storage position with respect to sleeve S.

Figure 2:
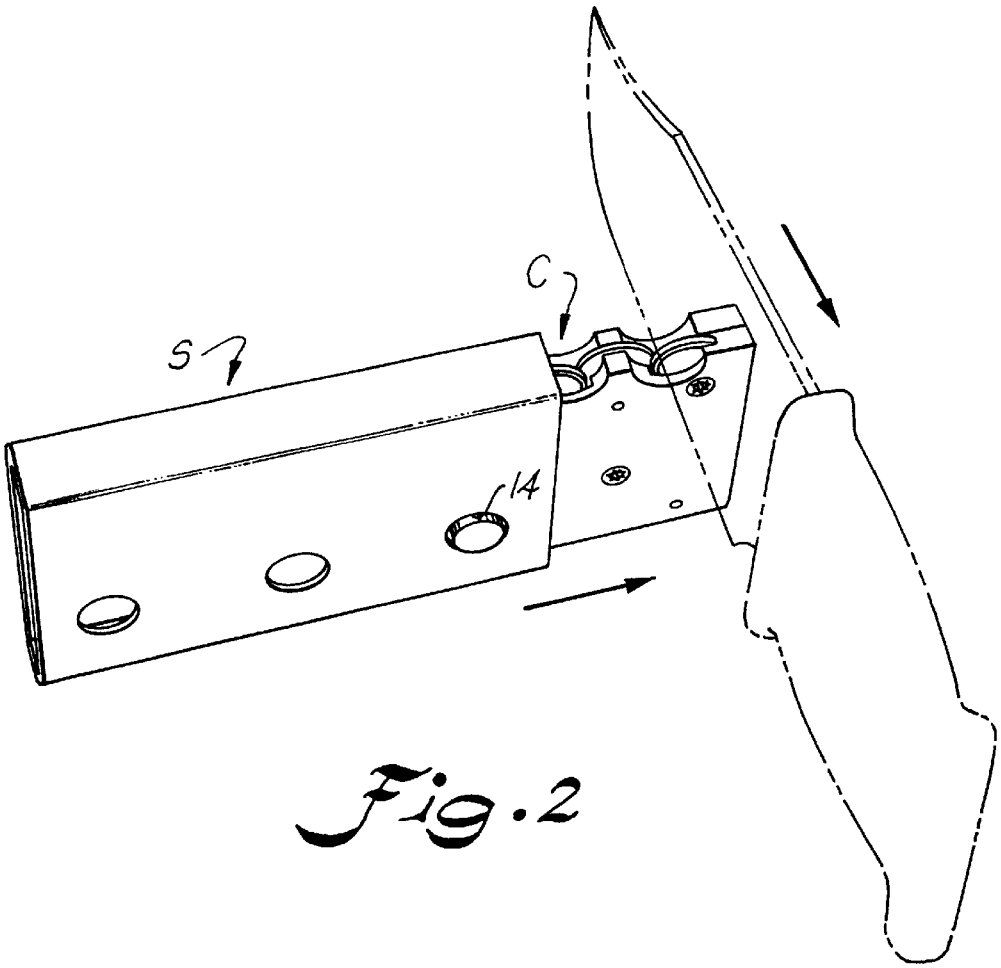
FIG. 2 is a perspective view of the blade sharpener of the present invention, illustrating the magazine and the set of coarse sharpening wheels being presented for sharpening a blade.
Figure 7:
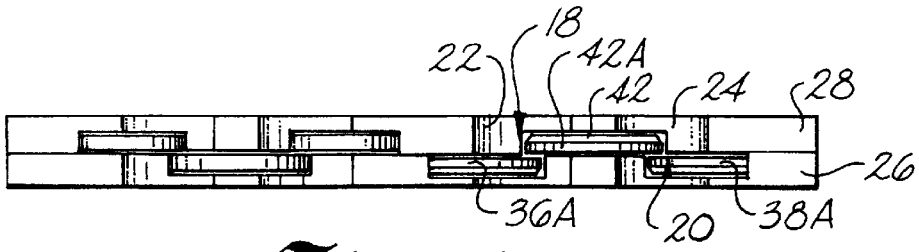
FIG. 7 is a view taken along lines 7—7 of FIG. 4.
Figure 8:
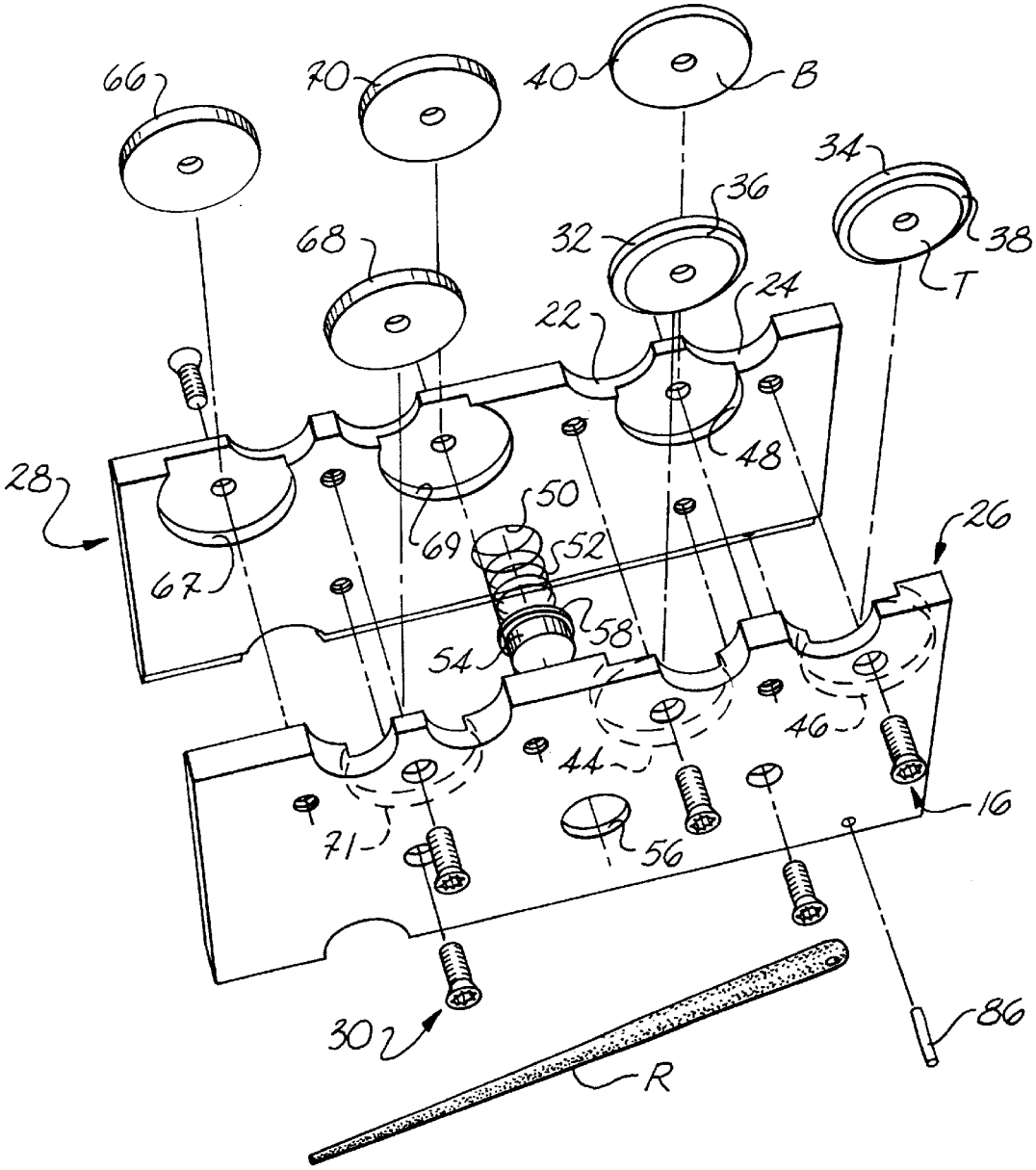
FIG. 8 is an exploded view of the magazine of the present blade sharpener.

FIG. 2 illustrates knife sharpener 10 with magazine M extending outwardly. To extend magazine M, pushbutton P is depressed such that it clears opening 12, and magazine M is moved relative to sleeve S such that pushbutton P registers with opening 14. This places magazine M in the coarse sharpening position, and exposes a set of three coarse sharpening wheels, generally C, overlapping one another. These wheels are preferably constructed of micro-grain tungsten carbide and are tapered, being generally of a conical frustum shape. As shown in FIG. 8, each wheel C includes a base portion B that is larger in diameter than top portion T, and each wheel is carried for rotation on a pin, or screw, generally 16, which allows the wheel C to passively rotate during sharpening. Alternately, the user may rotate wheels C manually to maintain good sharpening interfaces by allowing the best sharpening surfaces of the wheel C to be presented to the two nip zones, or sharpening interfaces, 18, 20 (FIG. 7) created by the sharpening wheels C. Magazine M defines first and second sharpening channels 22, 24 which are generally in alignment with sharpening interfaces, 18, 20, respectively.

Magazine M and sleeve S are preferably constructed of plastic, such as glass-filed nylon, but could also be constructed of metal, wood, fiberglass, or any other suitable material. Magazine M is preferably constructed of two portions, or halves, generally 26, 28, which are held together by attachment screws, generally 30.

It is to be noted here that the staggered orientation of the coarse sharpening wheels C with respect to one another. As best shown in FIG. 8, coarse wheels 32, 34 are arranged in a side-by-side relationship, with their respective generally conical tapered-in portions 36, 38 facing toward magazine portion 26. Generally straight-edged, or cylindrical portions, 36A, 38 border tapered-in portions 36, 38, respectively.

In contrast to coarse wheels 32, 34, coarse sharpening wheel 40, which is carried in portion 28, has its tapered-in portion 42 (FIG. 7) facing outwardly and away from portion 26, i.e., tapered-in portion 42, adjacent cylindrical portion 42A, of sharpening wheel 40 faces in the opposite direction from tapered-in portions 36, 38 of sharpening wheels 32, 34. The centerlines of wheels 36 and 40 are preferably equidistantly spaced from the centerline of wheel 40. This, together with the orientation of the tapered-in portions 42 of wheels C allows a blade to either be sharpened by a left-handed or right-handed user by sharpener 10, because a blade can be drawn through sharpening interfaces 18, 20 by drawing a blade therethrough either towards or away from magazine portion 26.

Magazine portion 26 includes recesses 44, 46 for receiving wheels 32 and 34, respectively, and magazine portion 28, includes recess 48 for receipt of wheel 40.

Also defined in magazine portion 28 is a recess 50 for receipt of a coil spring 52, which urges button 54 toward magazine portion 26. Magazine portion 26 includes pushbutton opening 56 through which button 54 is received, button 54 including a recess (not shown) for receipt of coil spring 52. A collar 58 is provided on button 50 to prevent button 54 from escaping opening 56.

Figure 3:
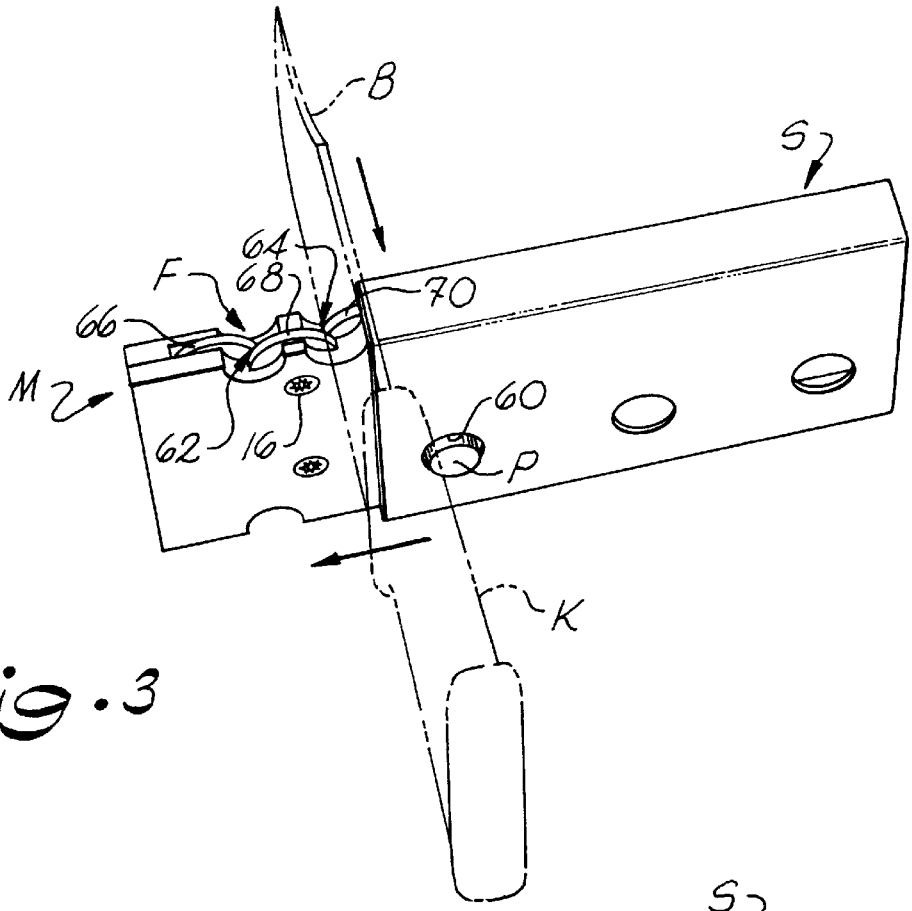
FIG. 3 is a perspective view of the blade sharpener of the present invention showing the magazine extended therefrom and presenting the fine sharpening wheels for use in providing a finish sharpening to a blade.

FIG. 3 illustrates magazine M being in a position for the finishing sharpening of a blade. Three finishing wheels, generally F, are rotatably carried in magazine M on axle screws 16. Finishing wheels F are preferably generally cylindrical in shape, and are preferably ceramic, being made of alumina silica. As shown in FIG. 3, pushbutton P is in opening 60, which maintain magazine M in the shown position with respect to sleeve S. Finishing sharpening interfaces 62, 64 are formed by finishing wheels 66 and 68, and finishing wheels 70 and 68, respectively. Sharpening channels 72 and 74 (FIG. 4) are also provided corresponding to sharpening interfaces 62, 64, respectively.

Magazine portion 28 includes recesses 67, 69 for receiving wheels 66 and 68, respectively, and magazine portion 26, includes recess 71 for receipt of wheel 70.

Figure 4:
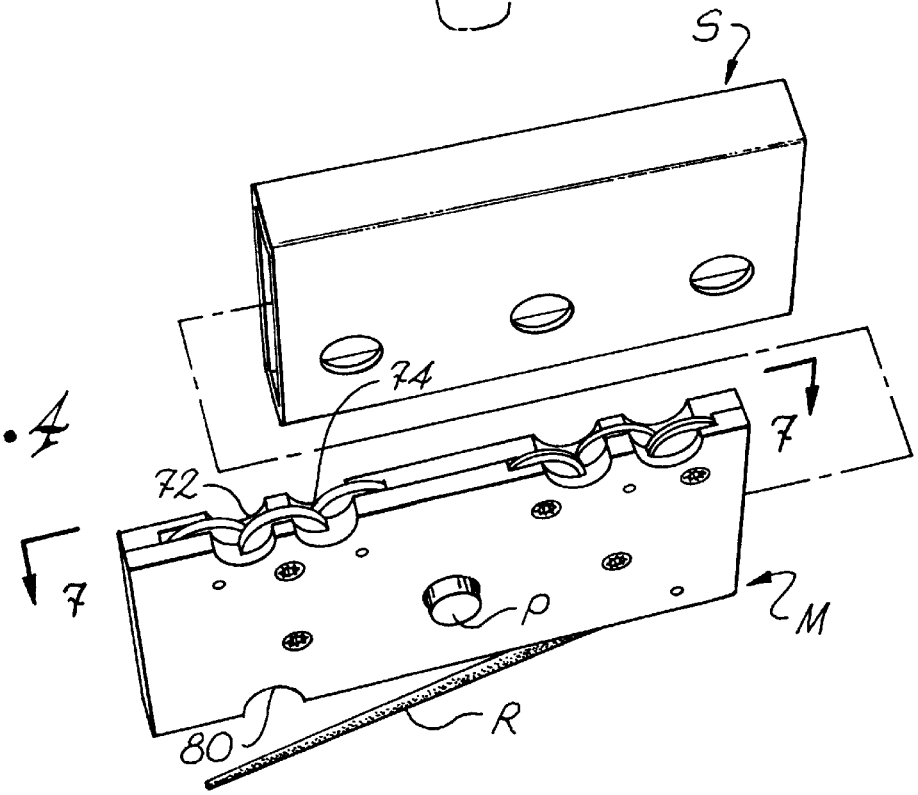
FIG. 4 is an exploded view of the blade sharpener constructed in accordance with the present invention, and further shows the sharpening rod carried by the magazine.
Figure 5:
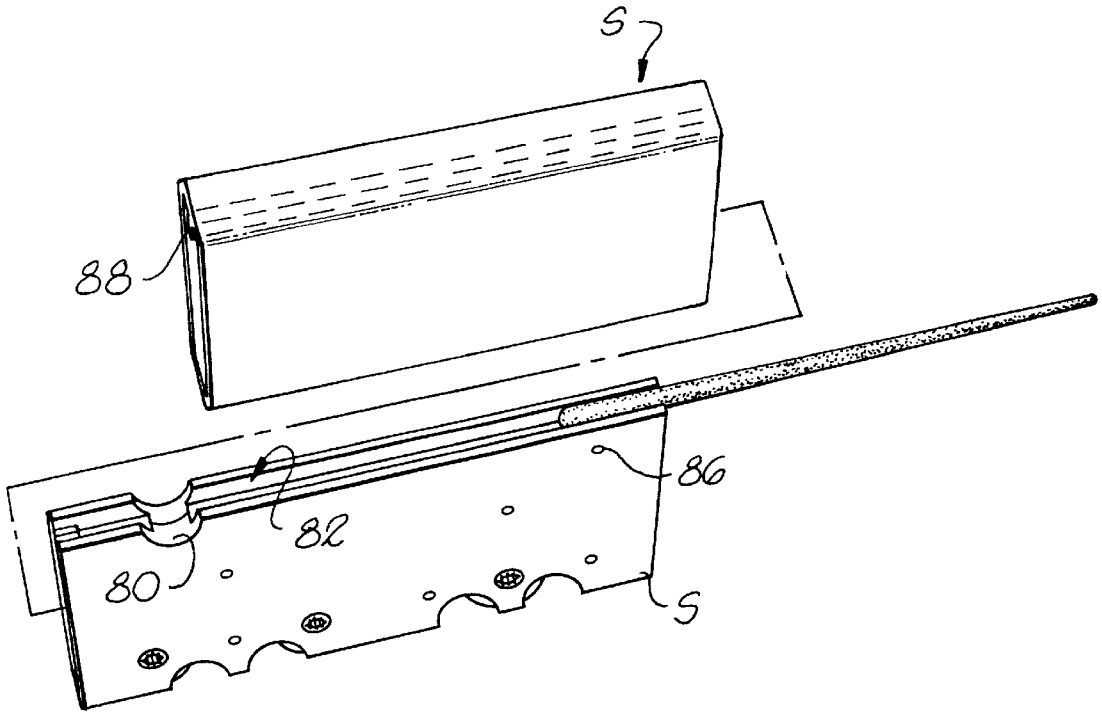
FIG. 5 is an exploded view of the other side of the blade sharpener illustrated in FIG. 4.

FIG. 4 also illustrates magazine M removed from sleeve S, and also illustrates sharpening rod, generally R. Sharpening rod R is accessed with magazine M removed from sleeve S. A recess 80 is provided in the underside of magazine M, which communicates with a groove 82 (FIG. 5) also defined in the underside 84 of magazine M. Rod R preferably has a fusion-welded tungsten carbide coating, or a diamond coating, with rod R itself being constructed of steel, plastic, or some other suitable material. Rod R is pivotally attached to magazine M used through a pivot pin 86. When rod R is pivoted from its storage position within groove 82, and extended outwardly therefrom, as shown in FIG. 5, it can then be reinserted into sleeve S. Sleeve S includes a downwardly extending elongated tongue, 88 which mates with groove 82, upon insertion of magazine M within sleeve S.

Figure 6:
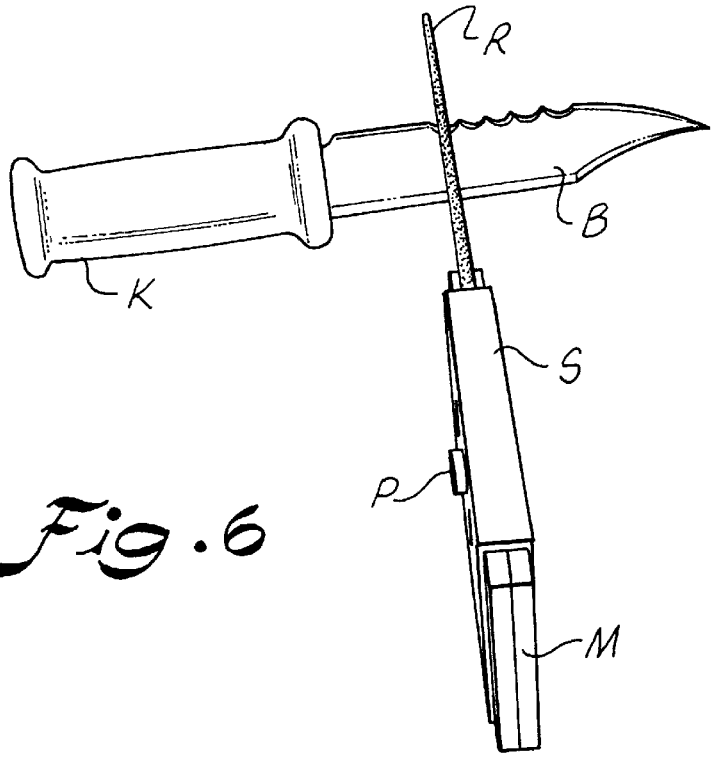
FIG. 6 illustrates the sharpening of a serrated edged blade with the sharpening rod of the blade sharpener of the present invention.

As shown in FIG. 6, upon magazine M being reinserted in sleeve and pushbutton P is extending through opening 12 therein. In this configuration, rod R is rigidly held in place, to allow it to be drawn or moved along a serrated edge, 90 of a blade.

When it is desired to sharpen a blade, such as a blade B of a knife K, magazine M would typically be moved to the position as shown in FIG. 2, thereby exposing coarse sharpening wheels C. Blade then is first drawn through sharpening interface 18 for several strokes, and then is removed from sharpening interface 18, and transferred to sharpening interface 20, where again, blade B is drawn through several times. This causes both edges of the blade to be sharpened, the right edge of the blade being in sharpening interface 18, and the left edge of the blade, being sharpened in sharpening interface 20.

Once the blade B has thus been provided a coarse sharpening, magazine M is then moved to the position such that pushbutton P registers with opening 60 in sleeve S. This exposes the finishing sharpening wheels F. The basic procedure discussed with respect to the coarse sharpening wheels is repeated, i.e., the blade is drawn through several times through sharpening interface 64, which provides a fine sharpening to the right edge of blade B, and then blade B is drawn through sharpening interface 62 to provide a finished sharpened edge to the left side of blade B. Magazine M can then be returned to its storage position, with pushbutton P registering with opening 12 of sleeve S.

To sharpen a serrated blade, magazine M is removed entirely from sleeve S. Sharpening rod R is pivoted from channel 82 to a fully extended position. Magazine M is then inserted back into sleeve S and locked into place, preferably, with pushbutton P registering with opening 12. Rod R is then drawn across the serrated edges of blade B, as illustrated in FIG. 6, in order to sharpen the blade.

From the foregoing, it can be seen that the blade sharpener of the present invention provides a compact multipurpose sharpener, which allows both straight edged and irregular-shaped edged blades to be sharpened.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A sharpener for a blade, comprising:

an elongated body member;

at least two sharpening wheels mounted for rotation on said body member; a portion of each of said two sharpening wheels overlapping one another to define a first sharpening interface adapted for receiving the blade;

each of said sharpening wheels being of a generally frusto-conical shape and having a base portion and a top portion opposite said base portion, said base portion being of larger diameter than said top portion; and said base portion of each of said sharpening wheels facing an adjacent sharpening wheel.

2. A sharpener as defined in claim 1, further comprising a sleeve member defining a passage for sliding receipt of said body member; and said sleeve member being configured for covering said two sharpening wheels upon said body member being inserted in said passage.

3. A sharpener as defined in claim 1, further comprising said at least two sharpening wheels including first, second, and third sharpening wheels; said first and second sharpening wheels defining said first sharpening interface and said second and third sharpening wheels defining a second sharpening interface.

4. A sharpener as defined in claim 1, further comprising a sharpening rod attached to and extending outwardly from said body member.

5. A sharpener as defined in claim 4, wherein said sharpening rod is generally conical in shape.

6. A sharpener as defined in claim 4, wherein said sharpening rod includes a fusion-welded tungsten carbide coating.

7. A sharpener as defined in claim 4, wherein:

said body member defines an elongated recess; and said sharpening rod is pivotally attached to said body member and is movable between a retracted position within said elongated recess and an extended position extending outwardly from said body member.

8. A sharpener as defined in claim 1, further comprising:

a sleeve member defining a passage for sliding receipt of said body member;

said sleeve member being configured for covering said two sharpening wheels upon said body member being inserted in said passage; and a releasable fastener connected to said body member for selectively fixing said body member with respect to said sleeve member.

9. A sharpener as defined in claim 8, wherein said sleeve member defines a plurality of openings therein and wherein said releasable fastener is a spring-biased pushbutton carried on said body member.

10. A sharpener as defined in claim 1, further comprising at least two generally cylindrical sharpening wheels mounted for rotation on said body member; a portion of each of said generally cylindrical sharpening wheels overlapping one another to define a second sharpening interface.

11. A sharpener as defined in claim 8, further comprising said two generally cylindrical sharpening wheels including first, second, and third generally cylindrical sharpening wheels; said first and second generally cylindrical sharpening wheels defining said second sharpening interface and said second and third generally cylindrical sharpening wheels defining a third sharpening interface.

12. A sharpener as defined in claim 10, wherein said two generally cylindrical sharpening wheels are ceramic.

13. A sharpener as defined in claim 1, wherein said two sharpening wheels are tungsten carbide.

14. A method of sharpening a blade, comprising:

providing an elongated body member having three frusto-conically-shaped coarse sharpening wheels defining first and second coarse sharpening interfaces and three generally cylindrical finish sharpening wheels defining first and second finish sharpening interfaces;

drawing the blade through said first and then said second coarse sharpening interfaces; and then, drawing the blade through said first and then said second finish sharpening interfaces.

15. The method defined in claim 14, further comprising:

providing an elongated sharpening rod on said body member; and drawing said sharpening rod along said blade.

16. A sharpener for a blade, comprising:

an elongated body member;

first, second, and third coarse sharpening wheels mounted for rotation on said body member; said first and second coarse sharpening wheels defining said first coarse sharpening interface and said second and third coarse sharpening wheels defining a second coarse sharpening interface; and said first and second coarse sharpening interfaces being adapted for receiving the blade; and first, second, and third finish sharpening wheels mounted for rotation on said body member; said first and second finish sharpening wheels defining said first finish sharpening interface and said second and third finish sharpening wheels defining a second finish sharpening interface; and said first and second finish sharpening interfaces being adapted for receiving the blade.

17. The sharpener as defined in claim 16, wherein each of said first, second and third coarse sharpening wheels are of a generally frusto-conical shape and have a base portion and a top portion opposite said base portion, said base portion being of larger diameter than said top portion; and said base portion of said first, second, and third coarse sharpening wheels being adjacent to one another.

18. The sharpener as defined in claim 16, wherein said first, second and third finish sharpening wheels are of generally cylindrical shape.

* * * * *